US005156364A

United States Patent [19]

Hoffmann

[11] Patent Number: 5,156,364

[45] Date of Patent: Oct. 20, 1992

[54] ROOF GUTTER LIFTING ACCESSORY

[76] Inventor: George T. Hoffmann, 680 Van Voorhis Ave., Rochester, N.Y. 14617

[21] Appl. No.: 604,687

[22] Filed: Oct. 29, 1990

[51] Int. Cl.[5] ..... E04D 13/06

[52] U.S. Cl. ..... 248/48.2; 52/11

[58] Field of Search ..... 248/48.1, 48.2, 300, 248/248; 52/11, 12, 15

[56] References Cited

U.S. PATENT DOCUMENTS

| | | | |
|---|---|---|---|
| 2,147,799 | 2/1939 | Reynolds . | |
| 2,565,090 | 8/1951 | Ramser | 248/48.2 |
| 3,296,749 | 1/1967 | Cotter | 248/48.2 X |
| 3,630,473 | 12/1971 | Landis | 248/48.2 |
| 3,809,347 | 5/1974 | Pekarek | 248/300 X |
| 3,895,769 | 7/1975 | Hagaman . | |
| 3,915,418 | 10/1975 | D'Amato | 52/11 |
| 4,433,512 | 2/1984 | Schoener | 52/11 |
| 5,004,191 | 4/1991 | Corry | 52/15 |

*Primary Examiner*—J. Franklin Foss

[57] ABSTRACT

An accessory for use with an existing roof gutter support, such as the conventional ferrule and spike, operates as a jack for applying lifting forces to the existing gutter support for lifting and holding it in a position whereby the gutter is maintained perpendicular to the facia board. Gutters which have sagged may thus be restored to their original and level position. The accessory is provided by a generally triangular plate, having flanges along the base and a side thereof, which forms a preferrably acute angle with the base. The flange along the side is disposed in engagement with the existing gutter support and pivots about the apex of the base and side to jack up and lift the existing support or maintain it in level position. The lifting forces are applied when the base of the plate is tilted with the aid of an adjustable jack screw which extends there through its flange into the facia board and draws the base toward the facia board. The flange along the lifting side may be in the form of a channel which surrounds the gutter support (the ferrule).

12 Claims, 7 Drawing Sheets

ROOF GUTTER LIFTING ACCESSORY

DESCRIPTION

The present invention relates to a roof gutter lifting accessory to be used in conjunction with existing roof gutter supports, such as the spike and ferrule, for repair and elimination of sagging conditions as well as auxiliary reinforcement in existing roof gutter systems. More particularly the invention relates to a roof gutter lifting accessory which operates as a jack for lifting a sagging gutter support or for providing reinforcement for gutter supports against sagging out of desired level position.

The principal application for the roof gutter lifting accessories provided by the invention is as lifting devices to restore gutters which have sagged due to aging to their original level position. The accessory device of the invention permits the exact amount of lift required to be applied to any affected portions of a sagging gutter and enable that portion to be lifted so much as is necessary or desirable to obviate sagging conditions. The accessory device may also be used at the time of initial gutter installation to provide additional strength to roof gutter supports as may be required in areas where roof gutters frequently become clogged due to leaves, other debris, or due to ice buildup, and even where gutters are used for supporting heavy decorative items such as flower pots suspended therefrom.

Roof gutters are commonly installed on house roofs with spikes and ferrules. The spike is driven through both the forward and rear gutter walls with the ferrule between these walls. The spike is driven into the facia board, and desirably where the facia board is backed by a roof rafter. The ferrule acts as a spacer to keep the gutter walls separate from each other. The spike forms a cantilever to support the gutter in a level position and also holds the gutter against the facia board. Over time, some spikes gradually loosen due to fluctuating weight of water, leaves, ice and other debris int he gutter. This condition may be further exacerbated by clogging of the downspout from the gutter, freezing conditions and the aging of the wood in the facia board and rafters that hold the spikes. As the spikes loosen, they may droop and even partially pull out, thereby allowing the gutter to sag. The sagging gutter portions tend to provide containers for still more water, ice and debris adding even more weight and applying more strain to the spikes and the gutters may eventually fall off.

The problem has been approached in the past by using additional spikes and ferrules. Since usually all of the rafters are utilized by originally installed spikes, any additional spikes are likely to be installed in the facia board alone which provides only limited holding strength especially with aging thereof. Another approach is the installation of strap hangers where straps are attached to the gutter and then nailed to the roof either above or below the shingles. This techniques is expensive and undesirable since it detracts from the appearance of the premises and can introduce leaks into the roof. Of course the entire gutter system is often replaced at substantial cost. Alternatively special hangers and supports have been proposed which are stronger than the conventional spike and ferrule or which embrace the spike and ferrule. All of these supports are intended for original installations rather than for leveling sagging gutters. See Cotter, U.S. Pat. No. 3,296,749 issued Jan. 10, 1967, Ramser, U.S. Pat. No. 2,565,090 issued Aug. 21, 1951 and Hagaman, U.S. Pat. No. 3,895,769. A support used temporarily during initial installation of gutters is shown in Reynolds, U.S. Pat. No. 2,147,799 issued Feb. 21, 1939.

The present invention has as its principal feature the solution of problems of sagging gutters, loose spikes, aged, weakened facia boards in installed gutter systems and makes it possible to restore gutter installations which may be in relatively poor condition rapidly and at low cost. In so doing, the invention has the following features and advantages:

(a) permanently restores sagging gutters to their proper level positions;
(b) restoring the gutters to a condition where they will be as strong or stronger as when originally installed;
(c) ease of installation without removing the gutter;
(d) ease of installation without removing spikes and ferrules which are actually supported by the accessory provided by the invention;
(e) ability to be used even when the spikes are loose enough to wiggle or could even be pulled out by hand;
(f) installed using a single wood screw or sheet metal screw, acting as a jack screw, which provides sufficient holding strength for supporting the roof lifting device even when the facia board is in poor condition;
(g) installation is rapid and easily accomplished without professional assistance;
(h) the only tool required for installation is a screwdriver;
(i) the amount of lift is adjustable;
(j) the accessory may be used even where there is minimal room between the top of the gutter and the eaves of the roof;
(k) the installation of the accessory is not visible from the ground level;
(l) the accessory can be used on new gutter installations for greater reliability and/or to add strength to critical (high load bearing) areas of the gutter;
(m) the accessory is simple in design and low in cost;
(n) the accessory may be used on a colonial style and on half-round and other style gutter systems.

Briefly described, a roof gutter system lifting accessory embodying the invention is adapted for use in a gutter having a rear wall located against a facia board, the gutter also having a base and a front wall and a lip which is attached by an existing gutter support which extends from the lip to the rear wall and into the facia board. The accessory is provided by a plate which defines a triangle with a base and a side. The base and side define a pivot therebetween. A first flange extends from the extending side and engages the gutter support beneath that support. A second flange extends from the base to capture the jack screw protruding from the facia board with the pivot against the rear wall of the gutter so as to tilt, and in so tilting, lift the existing gutter support thereby leveling sagging gutters.

The foregoing and other objects, features and advantages of the invention as well as presently preferred embodiments thereof will become more apparent from a reading of the following description in connection with the accompanying drawings in which:

FIGS. 1-A through D are respectively front, left side, right side and top views of an accessory provided in accordance with a first embodiment of the invention;

FIGS. 2-A through D are respectively front, left side, right side and top views of an accessory provided in accordance with another embodiment of the invention;

FIG. 2-E is similar as to FIG. 2-C except that the top of the flange (marked 40B) extends perpendicularly to the plate 10 and the outer edge of 40B is parallel to the plate 10;

FIGS. 3-A through D are respectively front, left side, right side and top views of an accessory provided in accordance with still another embodiment of the invention;

Figure 1D:
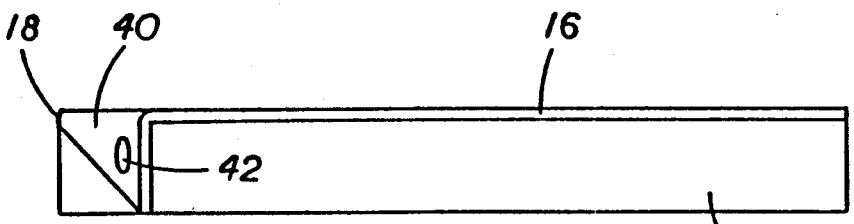
Figure 1C:
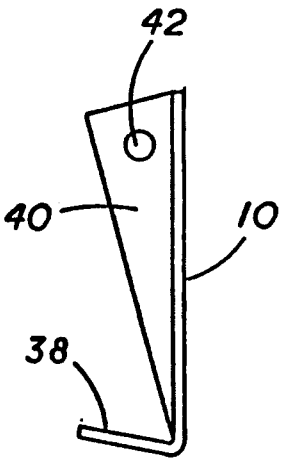
Figure 1A:
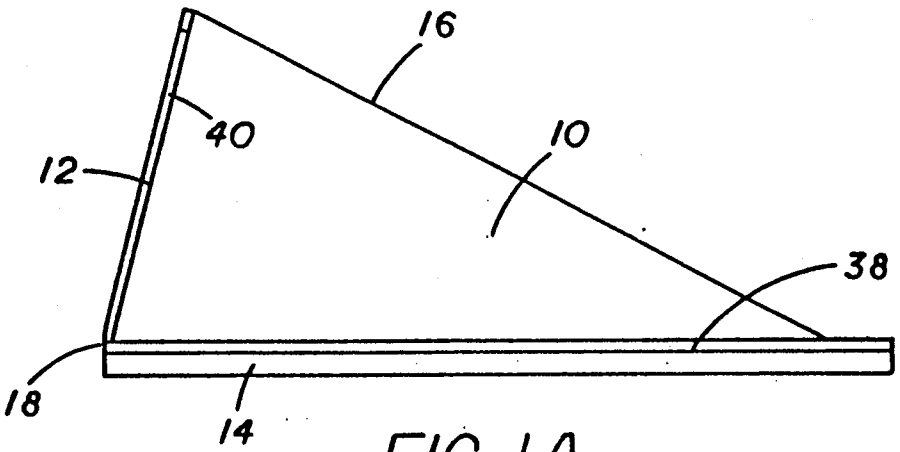
Figure 1B:
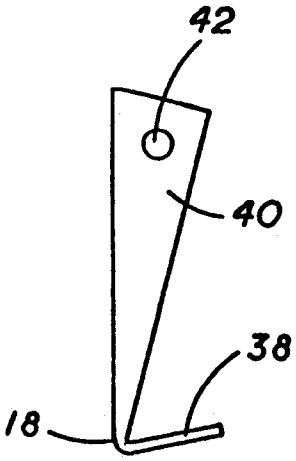
Figure 2E:
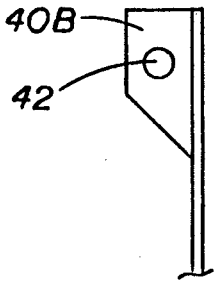
Figure 2C:
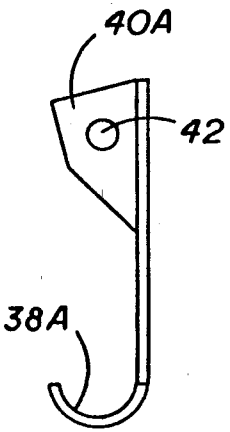
Figure 2D:
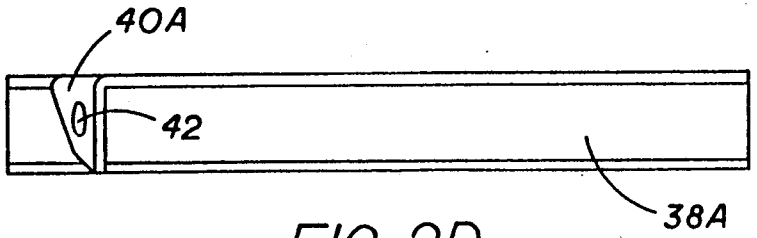
Figure 2A:
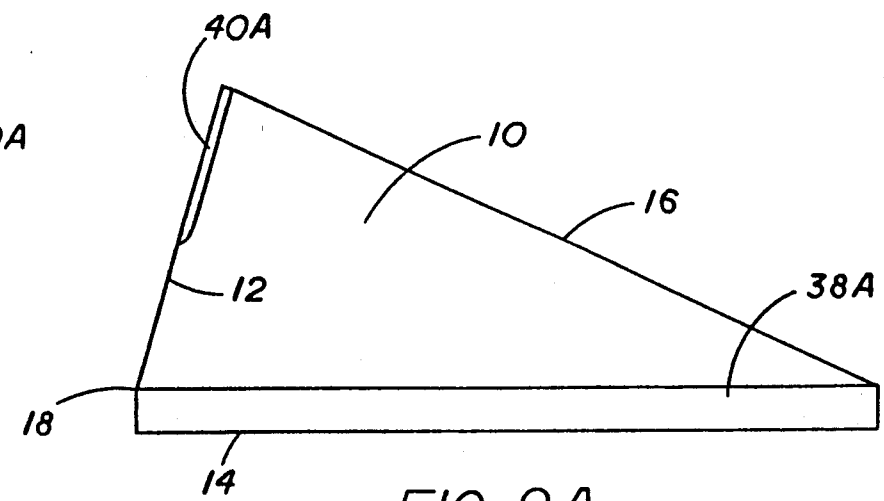
Figure 2B:
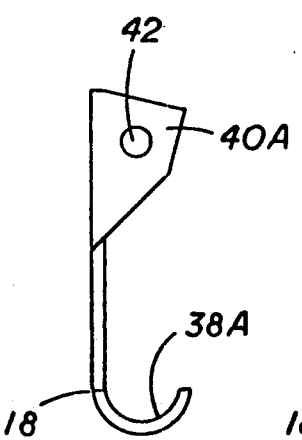
Figure 3E:
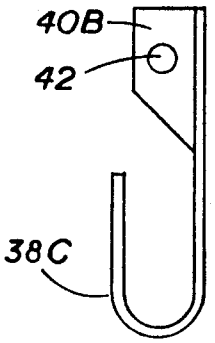
FIG. 3E is a view similar to FIG. 3C except that the channel 38C is semi-circular at the bottom and the flange 40B is as shown in FIG. 2E.
Figure 3C:
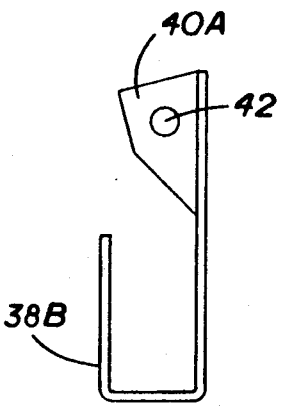
Figure 3D:
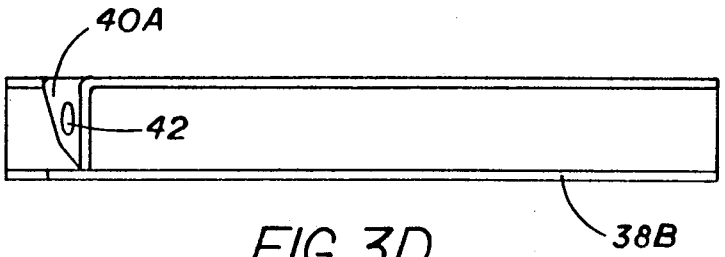
Figure 3A:
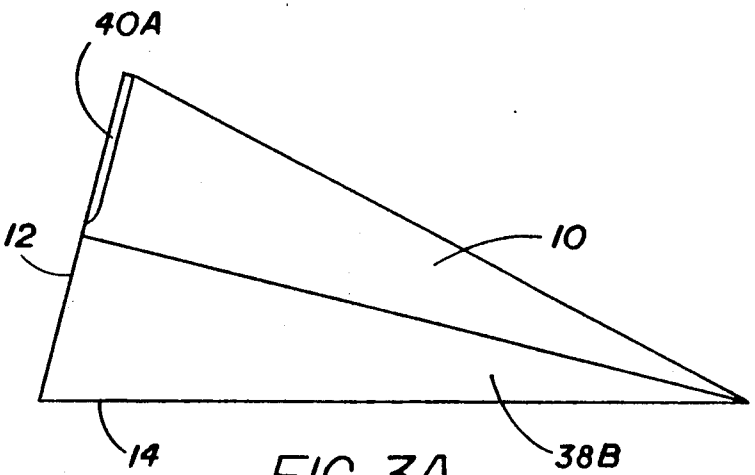
Figure 3B:
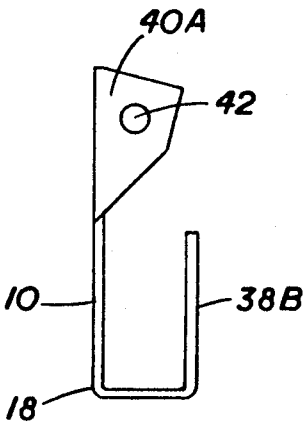
Figure 4:
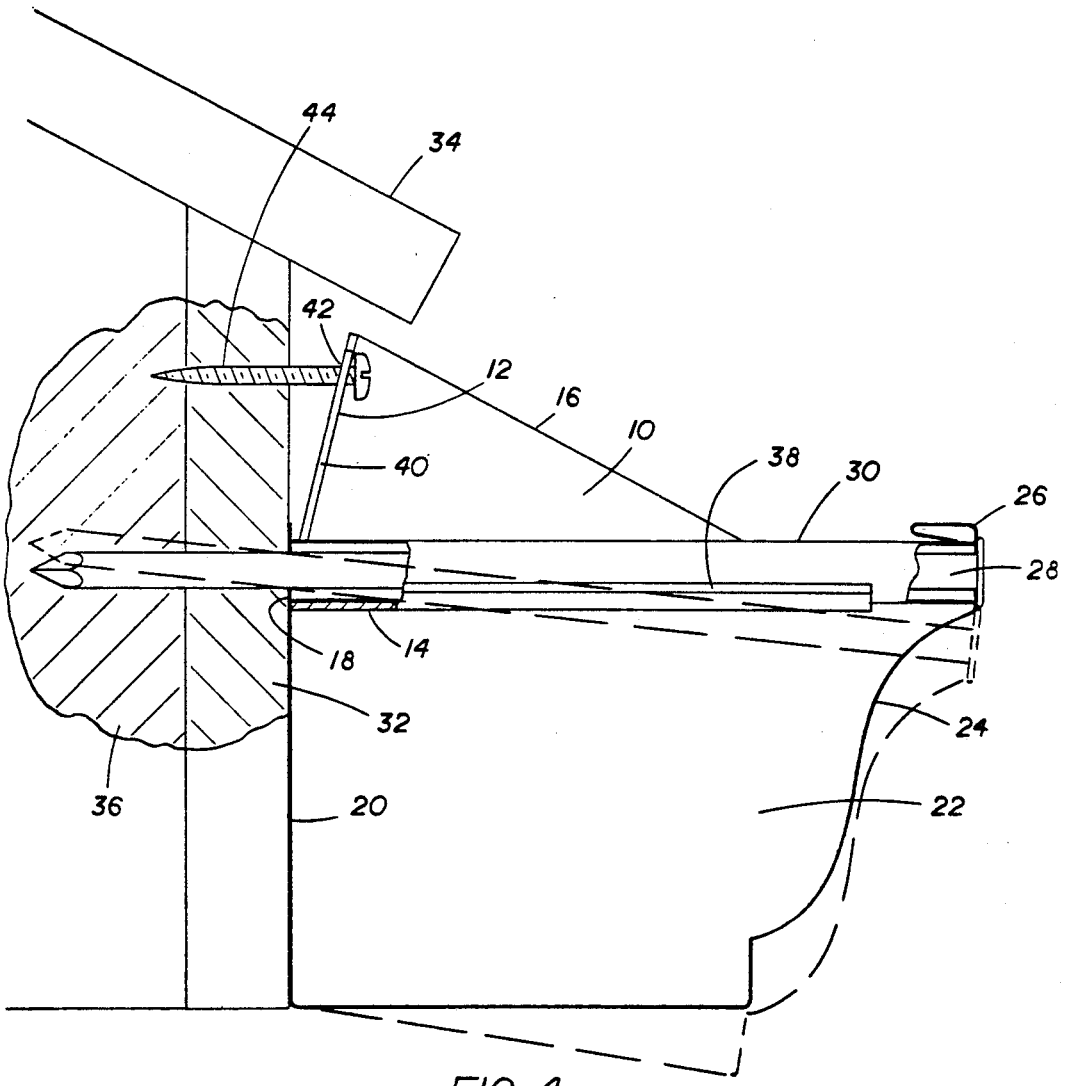
FIG. 4 is a sectional view taken transversely through a gutter and a ferrule and spike support therefore showing the accessory of FIG. 1 A-D installed therein; approximately in the center of its total lifting stroke range.
Figure 6B:
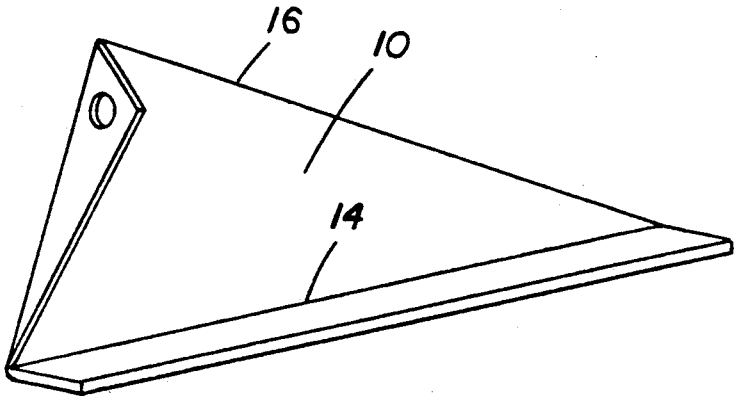
Figure 6A:
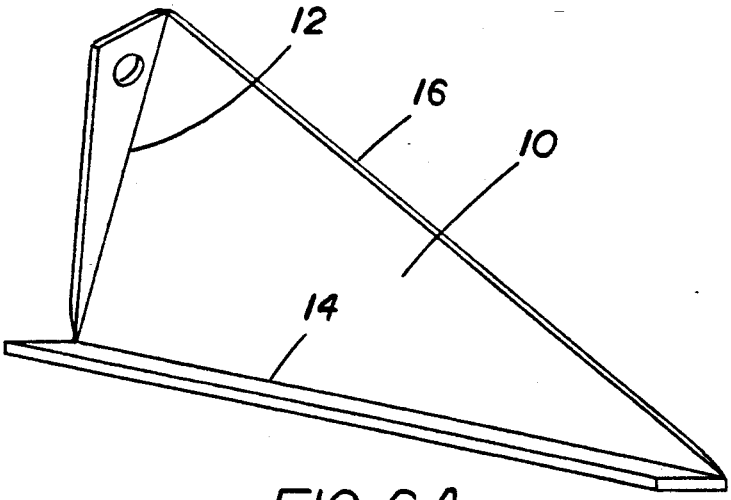
Figure 7:
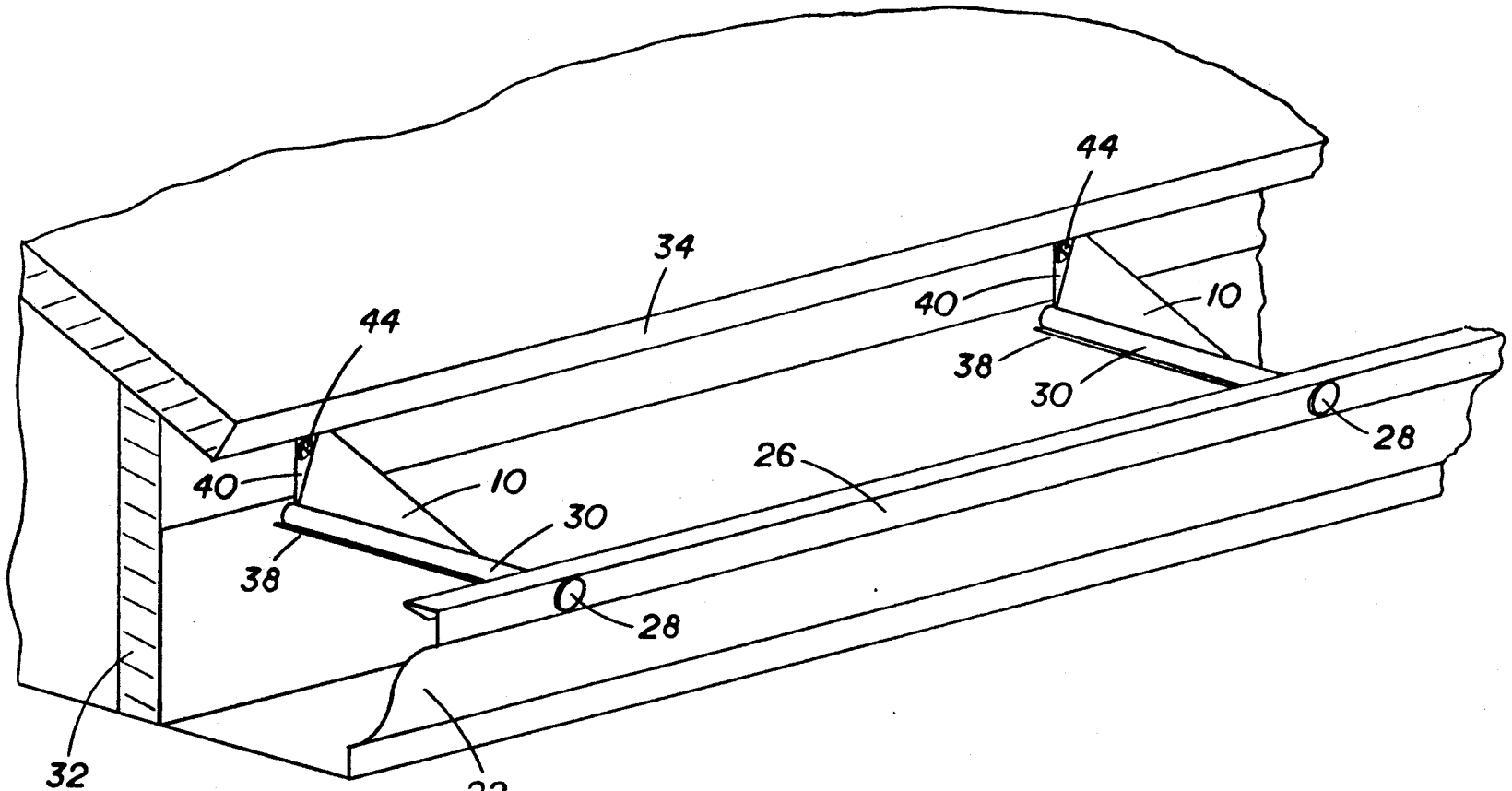

FIGS. 6-A and B are perspective views of the accessory shown in FIGS. 1-A and FIG. 4;

FIG. 7 is a perspective fragmentary view illustrating a section of gutter wherein the accessory in FIGS. 1-A through D, FIG. 4 and FIG. 6 is installed.

Referring to FIGS. 1-A through D, 4, 6-A and B and 7 it will be seen that the accessory for the roof support is in the form of a generally triangular plate 10 defined by a base 12 and sides 14 and 16. The triangular plate is preferably a scalene triangle. However, it may be in isosceles triangle with the sides 14 and 16 of equal length. The triangle has acute angles at each apex. The base 12 and the side 14 define a pivot 18 which is disposed against the rear wall 20 of the gutter 22. The gutter 22 has a front wall 24 with a lip 26. The gutter 22 is attached by a spike 28 and ferrule 30 to support to the facia board 32 below the roof 34. Preferably the spike 28 extends into a roof rafter 36.

In FIG. 4 the gutter 22 is shown in dash lines in sagged position. The pike also then is shown in dash lines in its sagged position.

The side 14 of the accessory device has a flange 38 which preferably defines an acute angle with the plate 10. This flange cradles the ferrule while the pivot 18 is disposed against the rear wall 20 of the gutter.

The base 12 has a flange 40. The flange 40 is generally triangular with its base adjacent the apex formed by the upper side 16 and the base 12 of the accessory. A hole 42 is disposed at the upper end of the flange 40 near its base. A wood or sheet metal screw 44 which acts as a threaded draw bar of jack screw is inserted through the hole. As the screw is screwed into the facia board 32 and rafter 36, it tilts the accessory about the pivot 18; bringing the lower side 14 and flange 38 upwardly. The flange 40 is tilted rearwardly an amount sufficient to level the gutter 22 (i.e., until the spike and ferrule stand perpendicular to the facia board 32).

Preferably the angle at the apex forming the pivot 18 (between the base 12 and said 14) is an acute angle. It is found that this angle is suitably about 75 degrees then the angle between the base 12 on the upper side is also about 75 degrees while the angle between the sides 14 and 16 is around 30 degrees. This acute angular relationship provides sufficient room for angular displacement (tilting) of the accessory device so as to straighten the gutter 22.

Figure 5:
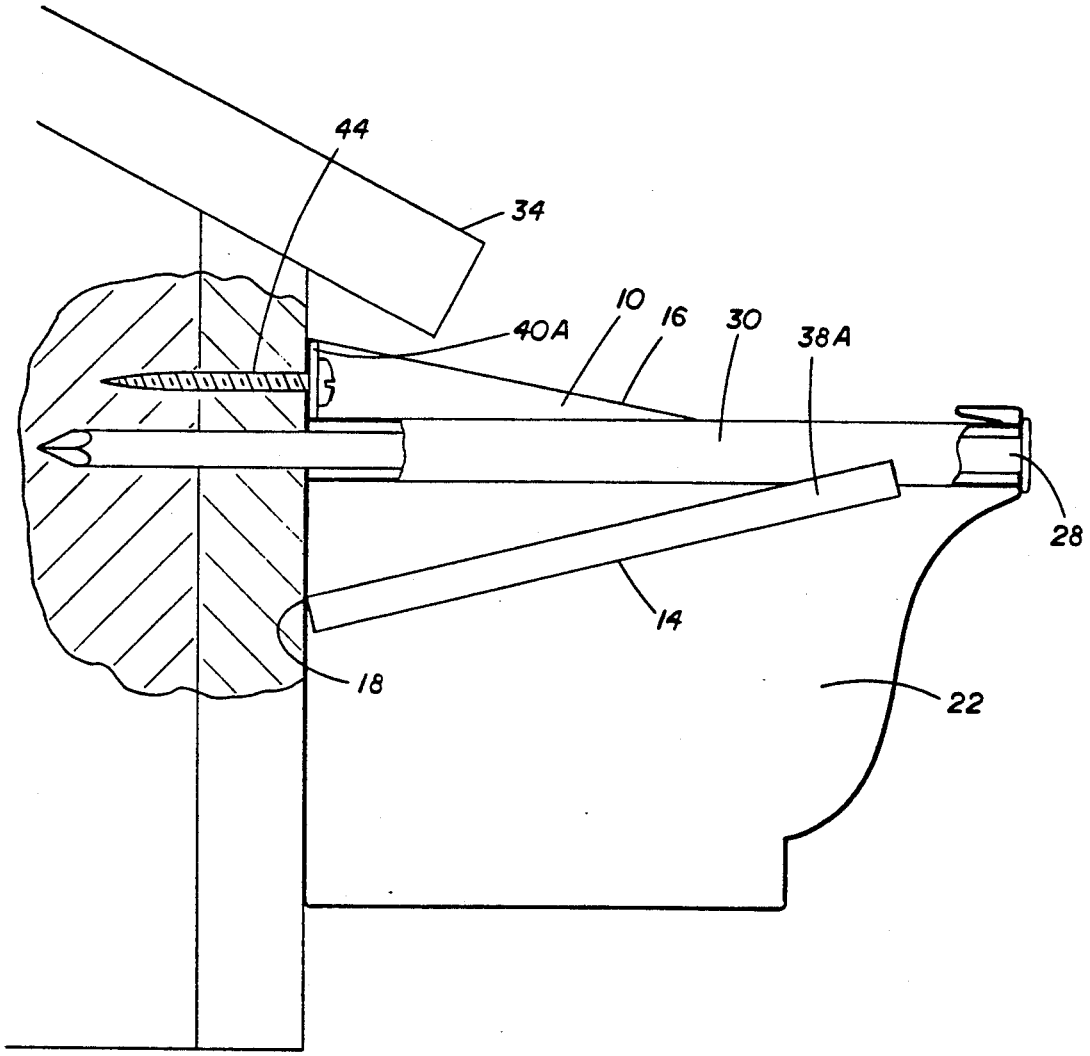
FIG. 5 is a view similar to FIG. 4 except the accessory is shown in the extreme upper position of its lifting stroke range.

Referring to FIGS. 2A–E, if there is insufficient room between the roof 34 and the gutter support (the ferrule 30 and spike 28), it is preferable to use a flange 40A which does not extend all the way down to the pivot point (i.e. along the base 12 to the lower side 14). Then the accessory device plate 10 can be fit with the flange above the ferrule 30. The apex between the sides 14 and 16 is engagement with the ferrule 30 with the devised plate 10 pivots at 18 which still acts as a fulcrum while the flange 30A engages the support device at the ferrule 30 enabling the support device and the gutter 22 to be lifted to level position as shown in FIG. 5. Also the flange 38A is semi-circular in cross section and of a diameter to cradle the ferrule.

In the event it is desired to cage more completely the ferrule and spike support, the flange 38 may be as shown at 38B in FIGS. 3-A to D in the form of a channel which slips around the ferrule 30. The channel may be semi-circular at its bottom as shown in FIG. 3E.

From the foregoing description and drawings it will be seen that there has been provided a simple and effective accessory for the support system of existing roof gutters. Various embodiments of the accessory have been shown which are specially adapted for different types of roof installations. Other applications, and installations and variations in the accessory, within the scope of the invention, will undoubtedly suggest themselves to those skilled in the art. Accordingly, the foregoing description should be taken as illustrative and not in a limiting sense.

I claim:

1. A roof gutter lifting accessory for use within an existing gutter having a rear wall located against a facia board from which a jack screw protrudes and a base and a front wall, which gutter is attached by a gutter support which extends from the lip to the rear wall and into the facia board, said accessory comprising a plate defining a triangle with a base and a side defining a pivot there between, a first flange extending form said side for engaging said support beneath said support, a second flange extending from said baser for engaging the jack screw protruding from said facia board with said pivot against said rear wall and being tiltable rearedly while being attached to said facia board to pivot said side and first flange as a level in a supporting relationship with said gutter support.

2. The accessory according to claim 1 wherein said side and said base form an acute angle there between.

3. A roof gutter support accessory for use within a gutter having a rear wall located against a facia board and a base and a front wall, which gutter is attached by a gutter support which extends from the lip to the rear wall and into the facia board, said accessory comprising a plate defining a triangle with a base and a side defining a pivot there between, a first flange extending from said side for engaging said support beneath said support, a second flange extending from said base for attachment to said facia board with said pivot against said rear wall and being tiltable rearedly while being attached to said facia board to pivot said side and first flange as a lever in a supporting relationship with said gutter support, said side and said base forming an acute angle there between, and said plate having a second side, said second side also forming a second acute angle with said base.

4. The accessory according to claim 3 wherein said side and base form a scalene triangle.

5. The accessory according to claim 3 wherein said acute angles are equal and said triangle is isosceles.

6. The accessory according to claim 3 wherein said first and second acute angles are about 75 degrees and said first and second sides form an angle about 30 degrees.

7. The accessory according to claim 3 wherein said first flange defines with said plate a channel for receiving said gutter support.

8. The accessory according to claim 3 wherein said gutter support comprises a ferrule between said front wall and said rear wall, and a spike extending through said front wall, said ferrule and said rear wall into said facia board.

9. The accessory according to said claim 3 wherein second flange is generally triangular in shape tapering from a base adjacent to said second side to a apex at said first side, and an attachment receiving hole in said second flange closer to said base than to said apex thereof.

10. The accessory according to claim 3 wherein said second flange extends from second side partially to said first side along said base and an attachment receiving hole in said second flange.

11. The accessory according to claim 10 wherein said first flange defines with said plate a channel for receiving said gutter support which is in the form of a ferrule having a spike extending there through.

12. The accessory according to claim 3 wherein said first flange is semi-circular at its bottom.

* * * * *